US005114195A

United States Patent [19]

Martin et al.

[11] Patent Number: 5,114,195

[45] Date of Patent: May 19, 1992

[54] TAMPER RESISTANT MAGNETIC GATE LOCK

[75] Inventors: Ronald R. Martin, Carroll County; James L. Hunter, Coweta County, both of Ga.

[73] Assignee: Southwire Company, Carrollton, Ga.

[21] Appl. No.: 469,908

[22] Filed: Jan. 25, 1990

[51] Int. Cl.[5] ..... E05C 19/16

[52] U.S. Cl. ..... 292/251.5; 292/DIG. 53; 335/294

[58] Field of Search ..... 292/251.5, DIG. 53, 292/DIG. 64, 144, 341.16; 70/DIG. 57, 276; 335/290, 294

[56] References Cited

U.S. PATENT DOCUMENTS

| | | | |
|---|---|---|---|
| 2,801,870 | 8/1957 | Davey | 292/251.5 |
| 2,871,676 | 2/1959 | Miller et al. | 292/251.5 |
| 3,232,654 | 2/1966 | Israelson et al. | 292/341.16 |
| 3,413,026 | 11/1968 | Kendrick et al. | 292/144 |
| 3,600,025 | 8/1971 | Brainard | 292/251.5 |
| 3,658,370 | 4/1972 | Wang | 292/201 |
| 4,339,629 | 7/1982 | Stanmore | 70/DIG. 57 X |
| 4,567,741 | 2/1986 | Trempala | 70/DIG. 57 X |
| 4,656,850 | 4/1987 | Tabata | 70/276 |
| 4,669,766 | 6/1987 | Hanchett, Jr. et al. | 292/251.5 |
| 4,696,500 | 9/1987 | Zunkel | 292/251.5 |
| 4,703,962 | 11/1987 | Kelly et al. | 292/251.5 |
| 4,991,887 | 2/1991 | Hahn | 292/144 X |

FOREIGN PATENT DOCUMENTS

| | | | |
|---|---|---|---|
| 1067335 | 10/1959 | Fed. Rep. of Germany | 292/251.5 |
| 68980 | 3/1958 | France | 292/144 |
| 1180547 | 12/1958 | France | 292/251.5 |
| 2483501 | 12/1981 | France | 292/251.5 |
| 0039947 | 3/1977 | Japan | 292/144 |
| 1138231 | 12/1968 | United Kingdom | 292/251.5 |
| 2040351 | 8/1980 | United Kingdom | 292/251.5 |

*Primary Examiner*—Lloyd A. Gall

*Attorney, Agent, or Firm*—Stanley L. Tate; James W. Wallis, Jr.

[57] ABSTRACT

An apparatus for locking doors and gates is disclosed. The apparatus generally comprises a housing containing a permanent magnet and an electromagnet for locking and unlocking the door or gate and contact means on the door or gate for engaging the permanent magnet in order to lock the door or gate. The electromagnet, when energized, has a magnetic field opposing the magnetic field of the permanent magnet to magnetically disengage the permanent magnet from the contact means.

7 Claims, 2 Drawing Sheets

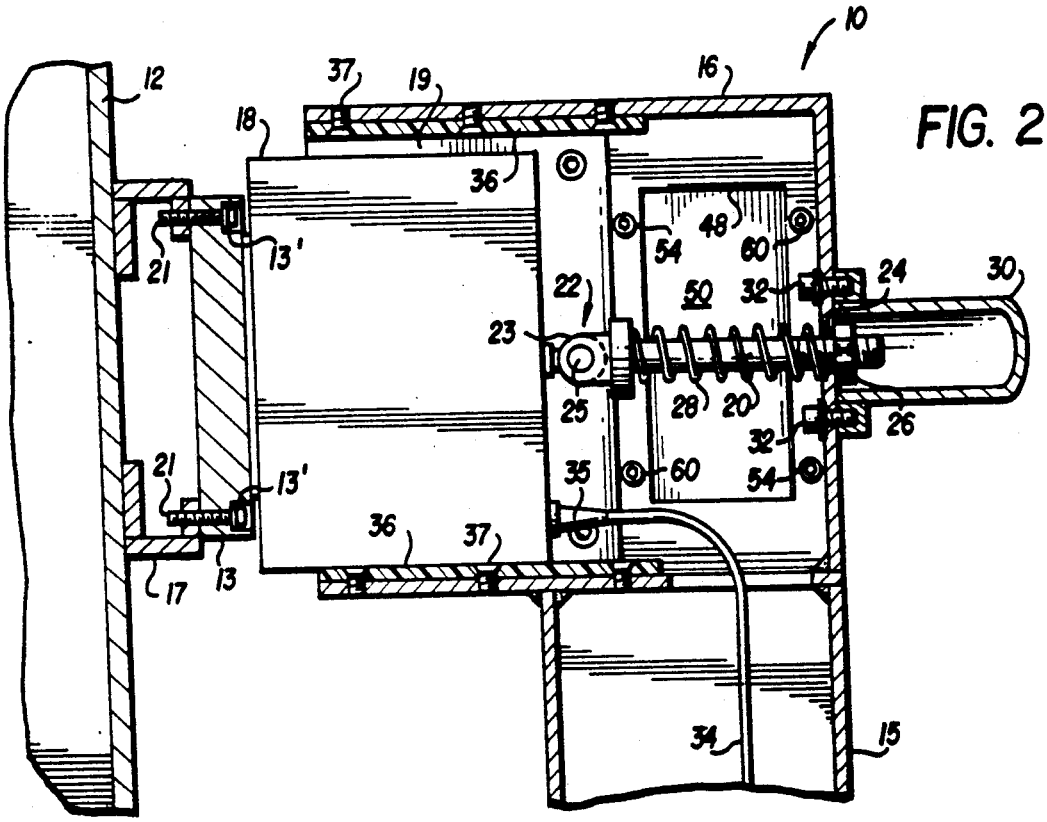
FIG. 2
FIG. 3
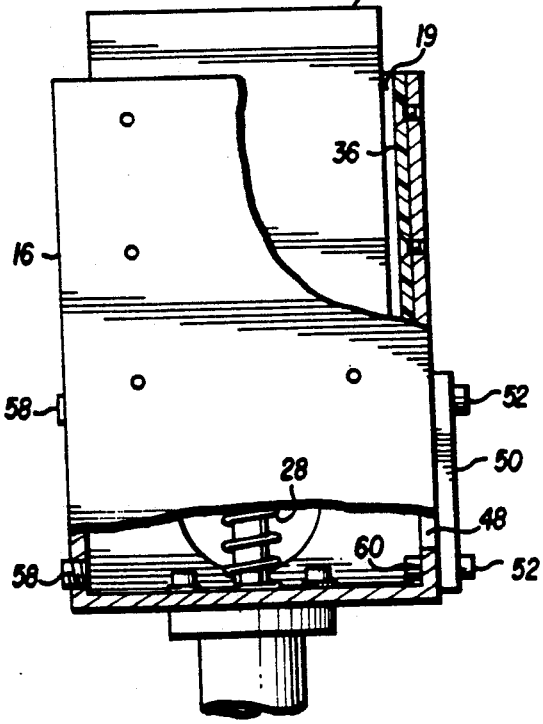
FIG. 4
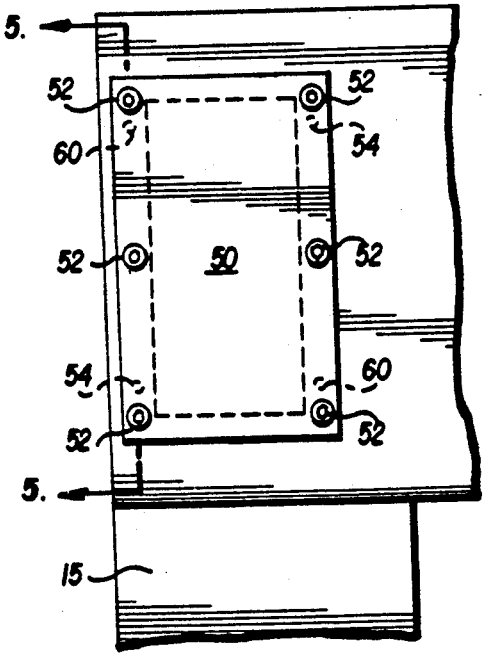

TAMPER RESISTANT MAGNETIC GATE LOCK

FIELD OF THE INVENTION

The present invention relates to new and useful improvements in devices for locking doors or gates, and more particularly, to a tamper-resistant locking mechanism which employs a magnet.

DESCRIPTION OF THE PRIOR ART

Gate and door locking apparatus which utilize magnets are generally one of two types. Either the magnet itself directly contacts and locks the door or gate closed, or, alternatively, the magnet is in contact with an intermediate member, such as a latch, which engages the door or gate. The first type, which utilizes direct contact between the door and magnet, usually comprises an electromagnetic means for producing both a locking and unlocking force. A key disadvantage of this type of device is that if electrical power is interrupted, the lock becomes inoperative. The second type, which utilizes a latch or similar member intermediate the magnet and door, is disclosed in U.S. Pat. No. 4,656,850 to Tabata, and U.S. Pat. No. 3,658,370 to Wang. While the locks disclosed in these patents utilize a permanent magnet and an electromagnet to produce an unlocking magnetic force, a key disadvantage of these types of devices is that they comprise a number of moving parts which render them susceptible to malfunction.

A further disadvantage of magnetic locking apparatus in the prior art is that they are susceptible to tampering. An intruder can often simply remove the housing which encloses the locking mechanism and disengage the electromagnet mechanically or electrically by disconnecting the power supply.

SUMMARY OF THE INVENTION

In view of the foregoing, it should be apparent that a need still exists in the art for a locking device that avoids the problems inherent in the prior art systems. Accordingly, it is a primary object of this invention to provide a magnetic locking device which remains operative despite termination of electrical power.

Another object of this invention is to provide a magnetic locking device with a minimum of moving parts thereby minimizing the likelihood of malfunction.

Yet another object of this invention is to provide a magnetic locking device which is substantially tamper-resistant.

These and other objects and advantages that may become apparent hereinafter are accomplished in accordance with the present invention by providing a door or gate lock that employs a combination of a permanent magnet and an electromagnet. The permanent magnet operates to magnetically attract and directly retain the door or gate in a closed or locked position without the need for intermediate latching elements. The electromagnet is used for producing a magnetic field with a polarity opposing that of the permanent magnet to neutralize the magnetic field and permit the door or gate to be unlocked. Portions of the magnetic locking mechanism are mounted in a housing which may be accessed only by carrying out a sequential removal of exposed and hidden screws using a special tool, thus rendering the device tamper-resistant.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 2 is a vertical cross-sectional view of the door locking apparatus and housing of the invention;

FIG. 3 is a top view, partly broken, of the apparatus shown in FIG. 2;

FIG. 4 is a fragmentary side elevational view of the apparatus as viewed from the side opposite that shown in FIG. 2;

DETAILED DESCRIPTION OF A PREFERRED EMBODIMENT

Figure 1:
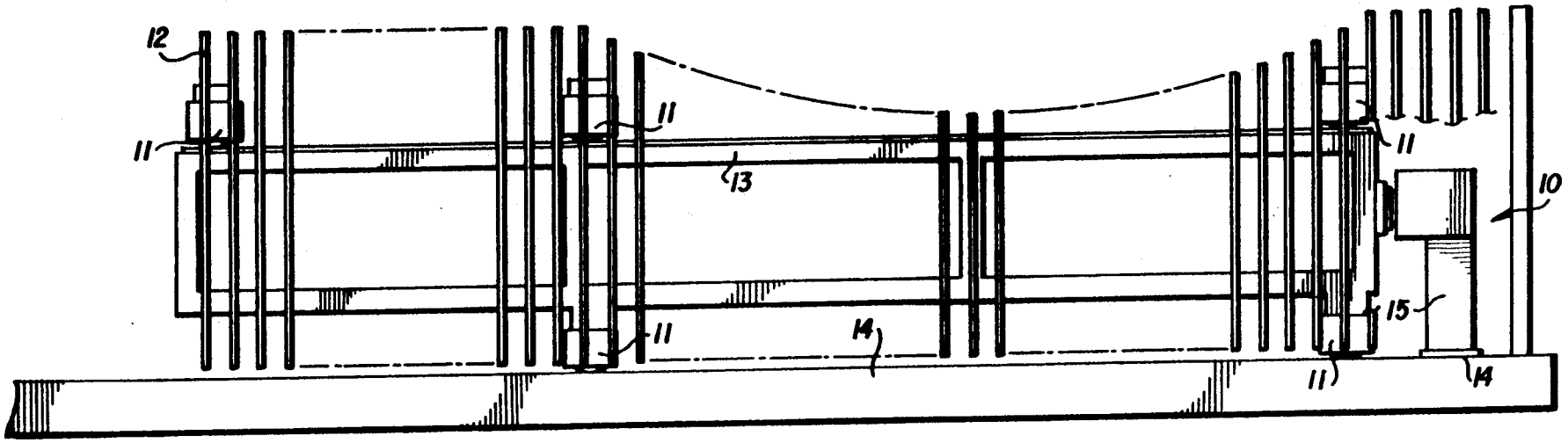
FIG. 1 is a front elevational view of a typical sliding gate with the door locking apparatus of the present invention shown engaged in the locked position.

Referring now in detail to the drawings wherein like parts are designated by like reference numerals throughout, there is illustrated in FIG. 1 a side view of the locking apparatus of the present invention designated generally reference numeral 10 shown in engagement with a typical sliding gate 12. Gate 12 is mounted on rollers 11 for rolling movement along a stationary frame 13 and a supporting platform or base 14. The locking apparatus 10 may mounted, as by welding, to a post 15 which is securely anchored to the base 14.

Referring now to FIG. 2 there is shown an elevational view, partly in section, of locking apparatus 10 engaging the gate 12. Intermediate apparatus 10 and gate 12 is contact plate 13 constructed of a ferrous material. The contact plate 13 is mounted by screws 21, to bracket 17 which is preferably welded to the gate 12. The heads of screws 21 are recessed in counterbores 13, in contact plate 13 to prevent access thereto when the locking apparatus 10 is engaged with the contact plate.

The locking apparatus 10 is comprised of a generally tamper-resistant housing 16 mounted, as by welding, to post 15. Slidably mounted within the housing is a conventional magnet means 18. Exemplary of the type of magnet means which may be employed is the Eriez model FS250 magnet comprising a permanent magnet and an electromagnet which, when energized, neutralizes the magnetic field of the permanent magnet. In order to magnetically isolate magnet means 18 from housing 16, non-magnetic pads 36, fabricated of polyethylene or the like, are mounted to the inside of the housing by screws 37. Additionally, pads 36 function to reduce friction between magnet means 18 and the housing wall 16. As explained below magnet means 18 is urged inwardly of the housing 16 after engagement by the gate 12. Space 19 is provided between the upper and side walls of magnet means 18 and the adjacent pads 36 (FIGS. 2 and 3) to accommodate any non-parallelism between the engaging surfaces of the contact plate 13 and the permanent magnet of magnet means 18.

A rod 20 is pivotally connected at a first end 22 to magnet means 18 by means of a clevis 23 and pivot shaft 25. The other or second end of the rod 20 is threaded and slidably extends through an aperture 24 provided in housing 16. A nut 26 positioned outside the housing is threaded on the threaded end of rod 20. Because the nut 26 has a dimension greater than that of aperture 24, movement of the rod into the housing (to the left as viewed in FIG. 2) is prevented so that the magnet means 18 cannot be pulled out of the housing 16. A spring 28 is disposed about rod 20 between clevis 23 and the inside wall of housing 16 such that magnet means 18 is resiliently biased in the direction of the gate 12. Accordingly, when the contact plate 13 mounted to gate 12 is rolled into contact with the magnet means 18 of locking apparatus 10, spring 28 dampens the impact, thereby lessening the likelihood of damage to the magnet means. A metal cap 30 is mounted to the rear of housing 10 to cover the protruding end of rod 20 and to prevent disablement of the lock by unthreading of the nut 26. Mounting is preferably accomplished in a tamper-resistant manner by means of bolts 32 which are accessible only from inside the housing 16.

In the use and operation of the present invention, gate 12 is rolled on rollers 11 into engagement with locking apparatus 10. When contact plate 13 engages magnet means 18, magnetic coupling occurs between the permanent magnet of magnet means and the contact plate, thereby locking the gate closed. In order to unlock the gate, electrical power is applied to the electromagnet in magnet means 18 via wire 34. As described above, energizing the electromagnet of magnet means 18 neutralizes the magnetic field of the permanent magnet resulting in a magnetic uncoupling of contact plate 13 from magnet means 18. Accordingly, gate 12 may be rolled on rollers 11 away from the locking apparatus 10.

It is a feature of the present invention that the locking apparatus remains functional despite loss or termination of electrical power. Accordingly, means are provided for mechanical unlocking if electrical demagnetization is not possible. An opening 48 is provided in housing 16 to provide access to the internal apparatus for repairs, cleaning and replacement of parts. Additionally, opening 48 is useful for providing access for mechanical unlocking. Removal of bolts 32 allows the release of cap 30 and provides access to nut 26. Removal of nut 26 effectively disengages the locking apparatus and permits the magnet means 18 to be withdrawn from the housing 16 in the direction of gate 12. The power cable 34 may be disconnected from the magnet means 18 at a plug 35, for example.

Figure 5:
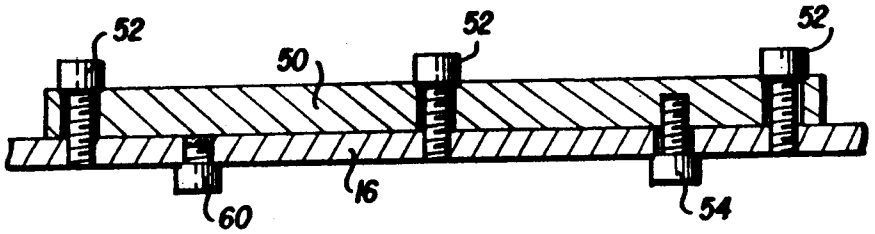
FIG. 5 is a fragmentary sectional view taken along line 5—5 of FIG. 4.
Figure 6:
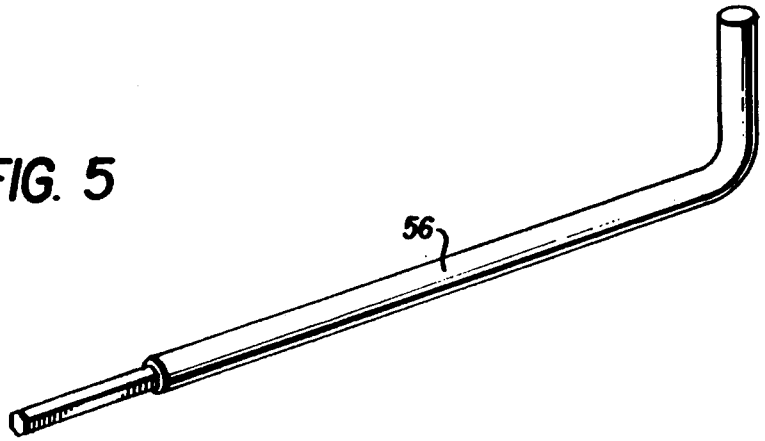
FIG. 6 is a perspective view of a special tool used for accessing the locking mechanism of the invention.

As shown best in FIGS. 4 and 5, security plate 50 is mounted to housing 16 and completely covers opening 48. The mounting of plate 50 to housing 16 is accomplished by a combination of operative and inoperative screws. A plurality of outer operative screws 52 (six screws in the embodiment shown) accessible from outside the housing are used to secure plate 50 to the housing. In order to prevent unauthorized individuals from removing plate 50 and disabling the locking device, plate 50 is secured by additional operative screws 54 (two in the embodiment shown) which are accessible only from inside the housing 16. To access operative screws 54, threaded plugs 58 must be removed from the housing wall opposite the two operative screws 54 by means of a special elongated tool 56 (FIG. 6) which must be inserted through the threaded holes provided for the plugs 58. The locations of the holes for two of the plugs 58 are aligned with operative screws 54 such that inserting tool 56 through the holes perpendicular to the planes of the housing walls will permit the tool to be engaged with the heads of operative screws 54.

To further deter tampering or attempts to disable the locking device by unauthorized persons who may obtain access to the special tool 56, a plurality of simulated or inoperative screws 60 (two in the embodiment shown) are fixedly mounted to the inside of housing 16 (FIG. 5). Simulated screws 60 have the same appearance as operative screws 54 and are also located directly across from plugs 58. However, whereas operative screws 54 threadably engage both housing 16 and plate 50 and may be removed therefrom, simulated screws 60 are fixedly mounted to the housing wall as by welding or other appropriate means. In fact, an attempt to unscrew one of the simulated screws 60 would likely cause special tool 56 to break, or cause stripping of the tool further deterring potential intruders. Obviously, the number and placement of operative screws 54 and simulated screws 60 may be varied so that the actual placement pattern would be known only by those with authority to open the locking apparatus.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A locking device for a door or gate comprising:

a housing having opposite sidewalls, one of said sidewalls having an opening for accessing the interior of the housing;

magnet means comprising a permanent magnet and an electromagnet mounted in said housing for locking and unlocking the door or gate;

contact means on the door or gate for magnetically engaging the permanent magnet to lock the door or gate;

said electromagnet, when energized, having a magnetic field opposing the magnetic field of the permanent magnet to magnetically disengage the permanent magnet from the contact means; and tamper resisting means on said housing for resisting tampering with the locking device, said tamper resisting means comprising a plate covering said opening, at least one operative fastener means for securing said plate to said one sidewall of the housing from the interior thereof, at least one inoperative means for simulating a fastener means for the plate, and means in the other sidewall for accessing said operative fastener means and said inoperative means.

2. A locking device for a door, or gate comprising:

a housing;

magnet means comprising a permanent magnet and an electromagnet mounted in said housing for locking and unlocking the door or gate;

contact means on the door or gate for magnetically engaging the permanent magnet to lock the door or gate;

said electromagnet, when energized, having a magnetic field opposing the magnetic field of the permanent magnet to magnetically disengage the permanent magnet from the contact means;

means in said housing for resiliently biasing the magnet means toward the door or gate, said biasing means comprising a spring mounted between said housing and said magnet means;

a rod having one end mounted to the magnet means and the other end extending slidably through an opening in said housing to the exterior thereof, said spring comprising a coil spring surrounding said rod, said other end of the rod being threaded and a retainer means threaded on said other end exteriorly of said housing for retaining the rod to said housing;

means on said housing for resisting tampering with the locking device, said tampering resisting means comprising a cup means mounted to the exterior of said housing over said other end of the rod and said retainer means for preventing disengagement of the retainer means from the other end of the rod, and means accessible only from the inside of said housing for securing the cup means to the housing.

3. A locking device for a door or gate comprising:

a housing having opposite sidewalls, one of said sidewalls having an opening for accessing the interior of the housing;

magnet means comprising a permanent magnet and an electromagnet mounted in said housing for locking and unlocking the door or gate;

means in said housing for resiliently biasing the magnet means toward the door or gate, said biasing means comprising a spring mounted between said housing and said magnet means;

a rod having one end mounted to the magnet means and the other end extending slidably through an opening in said housing to the exterior thereof, said spring comprising a coil spring surrounding said rod, said other end of the rod being threaded and a retainer means threaded on said other end exteriorly of said housing for retaining the rod to said housing;

contact means on the door or gate for magnetically engaging the permanent magnet to lock the door or gate;

said electromagnet, when energized, having a magnetic field opposing the magnetic field of the permanent magnet to magnetically disengage the permanent magnet from the contact means;

tamper resisting means on said housing for resisting tampering with the locking device, said tamper resisting means comprising a plate covering said opening, at least one operative fastener means for securing said plate to said one sidewall of the housing from the interior thereof, at least one inoperative means for simulating a fastener means for the plate, and means in the other sidewall for accessing said operative fastener means and said inoperative means.

4. The locking device of claim 3, wherein said tamper resisting means further comprises a cup means mounted to the exterior of said housing over said other end of the rod and said retainer means for preventing disengagement of the retainer means from the other end of the rod, and means accessible only from the inside of said housing for securing the cup means to the housing, said means for securing the cup means to the housing being accessible through the sidewall opening.

5. The locking device of claim 3, wherein said operative fastener means comprise a plurality of screws, said inoperative means comprising a plurality of simulated screws welded to the housing and said means for accessing said operative fastener means and said inoperative means comprising a plurality of threaded holes and a threaded plug for each threaded hole, a respective one of the threaded holes being disposed in the other sidewall in a position opposite a respective one of said operative fastener means and said inoperative means.

6. The locking device of claim 3, wherein said tamper resisting means further includes a special tool for operating said operative fastener means to disengage the same from said plate through said accessing means in the other sidewall.

7. A locking device for a door, gate comprising;

a housing;

magnet means comprising a permanent magnet and an electromagnet mounted in said housing for locking and unlocking the door or gate;

contact means on the door or gate for magnetically engaging the permanent magnet to lock the door or gate;

said electromagnet, when energized, having a magnetic field opposing the magnetic field of the permanent magnet to magnetically disengage the permanent magnet from the contact means;

means in said housing for resiliently biasing said magnet means toward the door or gate, said biasing means comprising a spring mounted between said housing and said magnet means; and a rod having one end mounted to the magnet means and the other end extending slidably through an opening in said housing to the exterior thereof, said spring comprising a coil spring surrounding said rod, said other end of the rod being threaded and a retainer means threaded on said other end exteriorly of said housing for retaining the rod to said housing, said one end of the rod being pivotally mounted to the magnet means by a clevis and pivot pin, said spring being disposed between said clevis and an end wall of the housing.

* * * * *